US009051089B2

(12) United States Patent
Jochem et al.

(10) Patent No.: US 9,051,089 B2
(45) Date of Patent: Jun. 9, 2015

(54) DRINK CUP AND LID

(75) Inventors: David J. Jochem, Evansville, IN (US); Milan C. Maravich, Evansville, IN (US); Jeffrey A. Mann, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 2359 days.

(21) Appl. No.: 11/876,831

(22) Filed: Oct. 23, 2007

(65) Prior Publication Data

US 2008/0041867 A1 Feb. 21, 2008

Related U.S. Application Data

(63) Continuation of application No. 11/210,085, filed on Aug. 23, 2005, now Pat. No. 7,318,536, and a continuation-in-part of application No. 10/824,753, filed on Apr. 15, 2004, now Pat. No. 7,055,715.

(51) Int. Cl.
*B65D 1/26* (2006.01)
*B65D 43/02* (2006.01)

(52) U.S. Cl.
CPC ..... *B65D 43/0208* (2013.01); *B65D 1/265* (2013.01); *B65D 2203/00* (2013.01); *B65D 2231/022* (2013.01); *B65D 2543/00027* (2013.01); *B65D 2543/00092* (2013.01); *B65D 2543/00296* (2013.01); *B65D 2543/00407* (2013.01); *B65D 2543/00509* (2013.01); *B65D 2543/00555* (2013.01); *B65D 2543/0062* (2013.01); *B65D 2543/00657* (2013.01); *B65D 2543/00685* (2013.01); *B65D 2543/00731* (2013.01); *B65D 2543/00796* (2013.01); *B65D 2543/00805* (2013.01)

(58) Field of Classification Search
CPC ..... B65D 1/265; B65D 2543/00027; B65D 2543/00657
USPC ..... 220/792, 787, 788, 789, 790, 791, 793, 220/794, 703, 709, 298, 229
See application file for complete search history.

(56) References Cited

U.S. PATENT DOCUMENTS

| | | | |
|---|---|---|---|
| 2,985,354 | A | 5/1961 | Aldington |
| 3,048,317 | A | 8/1962 | Cochrane et al. |
| 3,055,540 | A | 9/1962 | Ringlen |
| 3,065,875 | A | 11/1962 | Negoro |
| 3,262,602 | A | 7/1966 | McConnell et al. |

(Continued)

FOREIGN PATENT DOCUMENTS

DE 201 16 771 U1 12/2001

OTHER PUBLICATIONS

Supplementary European Search Report dated Apr. 6, 2009 for European Patent Application No. 05735742.8.

(Continued)

*Primary Examiner* — Fenn Mathew
*Assistant Examiner* — Christopher McKinley
(74) *Attorney, Agent, or Firm* — Barnes & Thornburg LLP

(57) ABSTRACT

A liquid container includes a brim forming an opening into a liquid reservoir chamber formed in the cup. A lid is coupled to the brim to form more than one seal with the container. The lid includes lid-removal blocker walls arranged to engage undercuts formed in the cup to retain the lid in a mounted position on the cup closing the opening into the liquid reservoir chamber.

22 Claims, 10 Drawing Sheets

(56) References Cited

U.S. PATENT DOCUMENTS

| | | | | |
|---|---|---|---|---|
| 3,349,950 | A | 10/1967 | Wanderer | |
| 3,612,342 | A | 10/1971 | Rathbun | |
| 3,677,435 | A | 7/1972 | Davis | |
| 3,679,088 | A | 7/1972 | Swett et al. | |
| 3,679,089 | A | 7/1972 | Swett et al. | |
| 3,743,133 | A | 7/1973 | Rathbun | |
| 3,805,991 | A * | 4/1974 | Cheladze et al. | 220/373 |
| 3,817,420 | A | 6/1974 | Heisler | |
| 3,977,563 | A | 8/1976 | Holt | |
| 4,006,839 | A | 2/1977 | Thiel et al. | |
| 4,026,459 | A | 5/1977 | Blanchard | |
| 4,054,229 | A | 10/1977 | Arfert | |
| 4,210,258 | A | 7/1980 | von Holdt | |
| 4,266,689 | A | 5/1981 | Asher | |
| 4,349,119 | A | 9/1982 | Letica | |
| 4,351,448 | A | 9/1982 | Ingersoll et al. | |
| 4,444,332 | A | 4/1984 | Widen et al. | |
| 4,446,986 | A | 5/1984 | Bowen et al. | |
| 4,474,305 | A | 10/1984 | Marco | |
| 4,508,235 | A * | 4/1985 | Steele et al. | 215/307 |
| 4,518,097 | A | 5/1985 | Milton et al. | |
| 4,562,937 | A | 1/1986 | Lyengar | |
| 4,640,435 | A | 2/1987 | Dutt | |
| 4,679,699 | A | 7/1987 | Malsbury et al. | |
| 4,721,210 | A | 1/1988 | Lawrence et al. | |
| 4,782,976 | A | 11/1988 | Kenyon | |
| 4,836,407 | A | 6/1989 | Bruce et al. | |
| 4,872,586 | A | 10/1989 | Landis | |
| 4,934,557 | A | 6/1990 | Smith | |
| 5,377,860 | A | 1/1995 | Littlejohn et al. | |
| 5,820,016 | A | 10/1998 | Stropkay | |
| 5,839,601 | A | 11/1998 | Van Melle | |
| 5,979,690 | A | 11/1999 | Hartley | |
| 6,056,144 | A | 5/2000 | Strange et al. | |
| 6,196,404 | B1 * | 3/2001 | Chen | 220/4.21 |
| 6,257,435 | B1 | 7/2001 | Chedister et al. | |
| 6,257,629 | B1 | 7/2001 | Weichelt | |
| 6,302,288 | B1 | 10/2001 | Nava et al. | |
| 6,357,619 | B1 | 3/2002 | Schaefer | |
| 6,419,112 | B1 | 7/2002 | Bruce et al. | |
| 6,460,716 | B1 | 10/2002 | Wong | |
| 6,688,487 | B2 | 2/2004 | Oakes et al. | |
| 6,910,599 | B2 | 6/2005 | Tucker et al. | |
| 6,932,234 | B2 | 8/2005 | D'Amato | |
| D516,910 | S | 3/2006 | Bresler | |
| 7,055,715 | B2 | 6/2006 | Maravich et al. | |
| 7,159,732 | B2 | 1/2007 | Smith et al. | |
| 2002/0037378 | A1 | 3/2002 | Littlejohn et al. | |
| 2003/0155353 | A1 | 8/2003 | Tucker | |
| 2004/0011803 | A1 | 1/2004 | D'Amato | |
| 2004/0094553 | A1 | 5/2004 | Crider et al. | |
| 2004/0159080 | A1 | 8/2004 | Stewart et al. | |
| 2004/0245261 | A1 | 12/2004 | Stanos et al. | |
| 2005/0109780 | A1 | 5/2005 | Pendergrass et al. | |
| 2005/0178766 | A1 | 8/2005 | Washington et al. | |
| 2005/0224505 | A1 | 10/2005 | Brown et al. | |
| 2005/0230406 | A1 | 10/2005 | Maravich et al. | |
| 2006/0060589 | A1 | 3/2006 | Lee | |

OTHER PUBLICATIONS

International Search Report and Written Opinion for PCT/US2008/054888, dated Jul. 9, 2008.

Supplementary European Search Report dated Jul. 28, 2008 for European Patent Application No. 06813520.1.

* cited by examiner

DRINK CUP AND LID

This application is a continuation of U.S. application Ser. No. 11/210,085, filed Aug. 23, 2005, and this application is a continuation-in-part of U.S. application Ser. No. 10/824,753, filed Apr. 15, 2004, both applications are expressly incorporated by reference herein.

BACKGROUND

The present disclosure relates to drink cups, and particularly to lids for drink cups. More particularly, the present disclosure relates to a seal established between a drink cup and a lid mounted on the drink cup.

SUMMARY

According to the present disclosure, a liquid container comprises a cup including a brim, a floor, and a side wall extending from the brim toward the floor. The side wall includes a radially inwardly facing first annular seal surface. The brim includes a radially inwardly facing second annular seal surface, an axially upwardly facing third annular seal surface, and a radially outwardly facing fourth annular seal surface.

The liquid container also comprises a lid including a closure and a fluted closure mount ring appended to the closure. The fluted closure mount ring is coupled to the brim to retain the closure in a position closing a mouth opening into a liquid reservoir chamber formed in the cup.

In illustrative embodiments, the closure mount ring includes four seal rings. A first seal ring is arranged to engage the radially inwardly facing first annular seal surface on the cup to establish a first liquid flow barrier therebetween. A second seal ring is arranged to engage the radially inwardly facing second annular seal surface on the cup to establish a second liquid flow barrier therebetween. A third seal ring is arranged to engage the axially upwardly facing third annular seal surface on the cup to establish a third liquid flow barrier therebetween and a fourth seal ring is arranged to engage the radially outwardly facing fourth annular seal surface on the cup to establish a fourth liquid flow barrier therebetween.

In illustrative embodiments, two annular retainers are included in the lid to engage annular inner and outer portions of the cup to help retain the lid in a mounted position on the cup closing an opening into a liquid reservoir chamber formed in the cup. A first lid-removal blocker wall is included in the lid and arranged to engage an annular undercut formed in the cup during movement of the lid in an outer direction away from the floor of the cup to provide a first of the annular retainers and block unwanted removal of the lid from the cup. A second lid-removal blocker wall is included in a peripheral portion of the lid and is arranged to engage a terminal end of the brim of the cup during movement of the lid in the outer direction to provide a second of the annular retainers and assist in blocking unwanted removal of the lid from the cup.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWING

The detailed description particularly refers to the accompanying figures in which.

DETAILED DESCRIPTION

Figure 1:
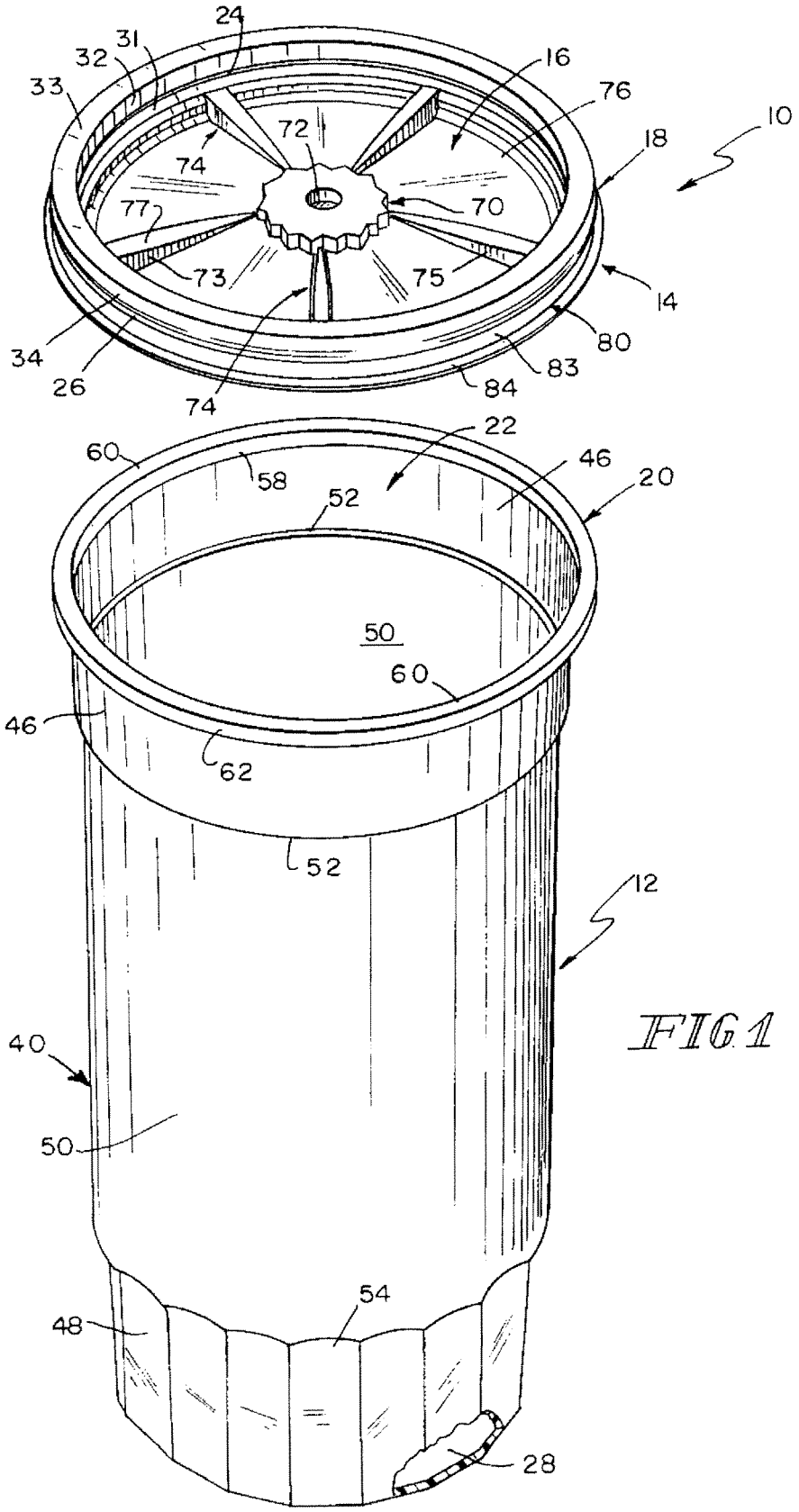
FIG. 1 is a perspective view of a lid in accordance with a first embodiment of the present disclosure and a cup before the lid is mounted on the cup.

A liquid container 10 includes a cup 12 and a lid 14 as shown in FIG. 1. Lid 14 includes a closure 16 and a closure mount 18 configured to be mounted on a brim 20 of cup 12 to arrange closure 16 to close an opening into a liquid reservoir chamber 22 formed in cup 12 as suggested in FIG. 6. A second lid 114 in accordance with the present disclosure is shown in FIGS. 7-12. A third lid 214 in accordance with the present disclosure is shown in FIGS. 13-20.

Figure 5:
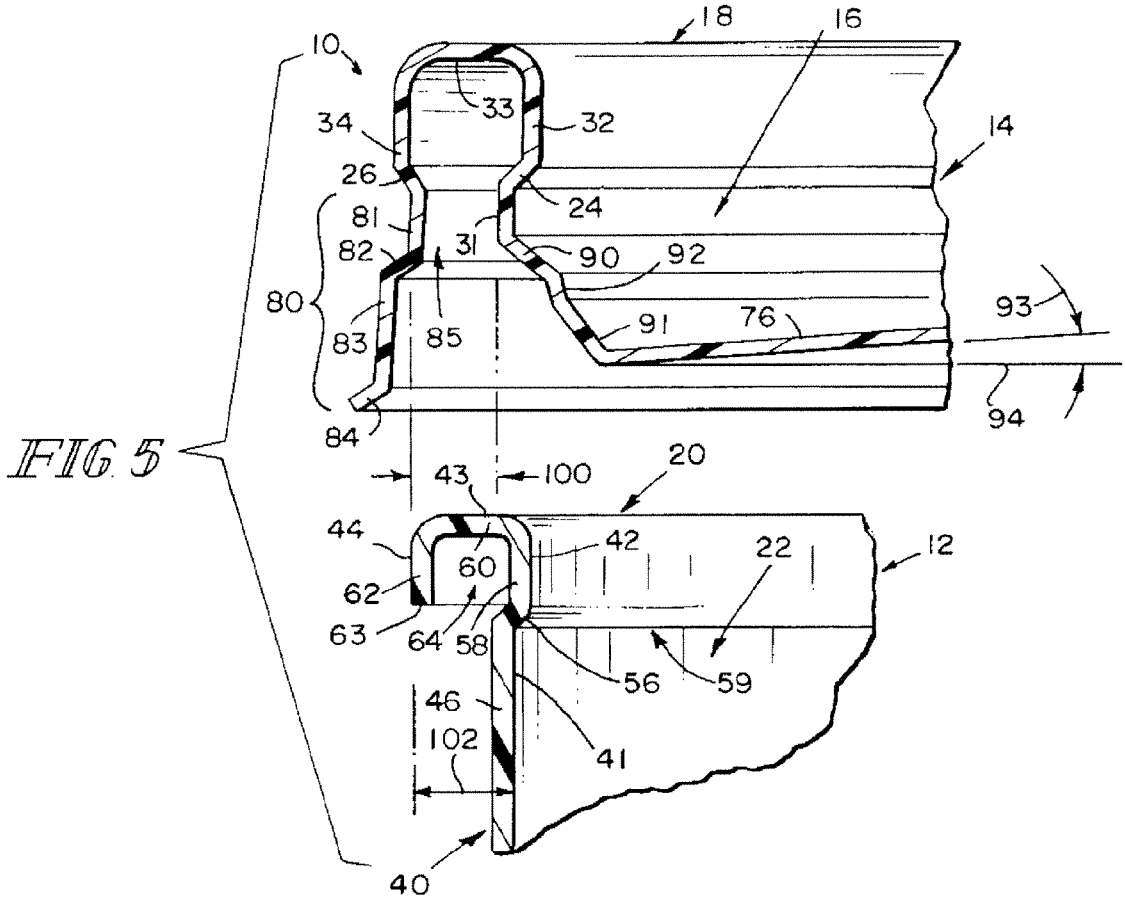
FIG. 5 is an enlarged sectional view of portions of the lid and cup of FIG. 1 before the lid is mounted on the cup.
Figure 6:
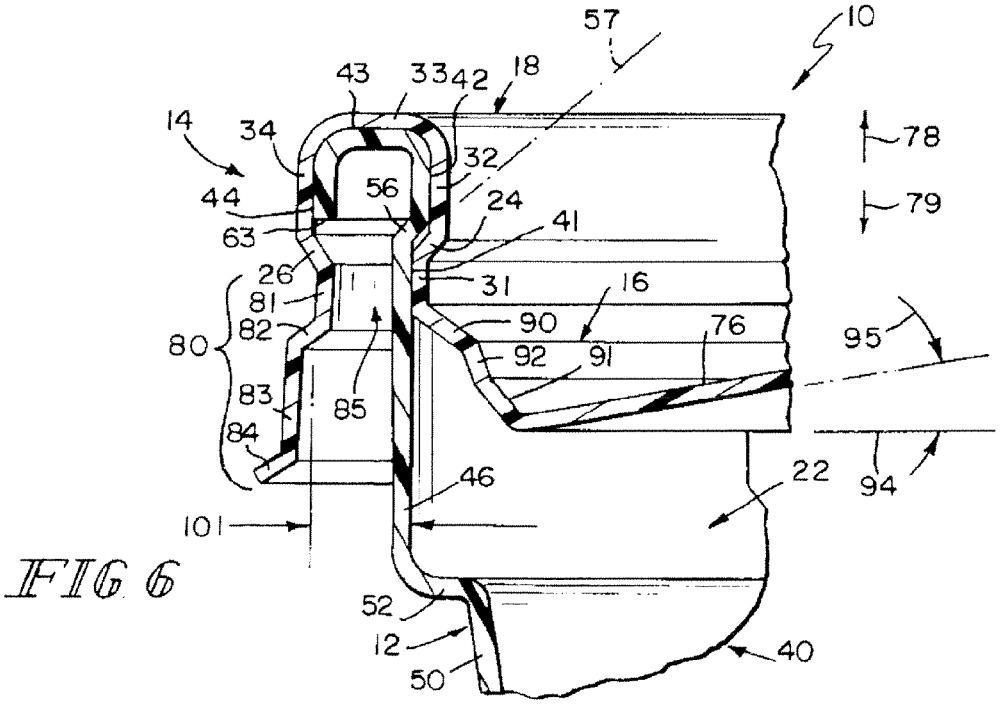
FIG. 6 is a view similar to FIG. 5 after the lid is mounted on the cup showing formation of a series of liquid flow barriers to retain liquid in a reservoir chamber formed in the cup owing to sealing engagement between the closure mount ring of the lid and both of a side wall and the brim of the cup and showing retention of the lid on the cup owing, in part, to engagement of a portion of the lid in an "undercut" formed on an interior surface of the cup at a junction between the side wall and the brim of the cup.
Figure 7:
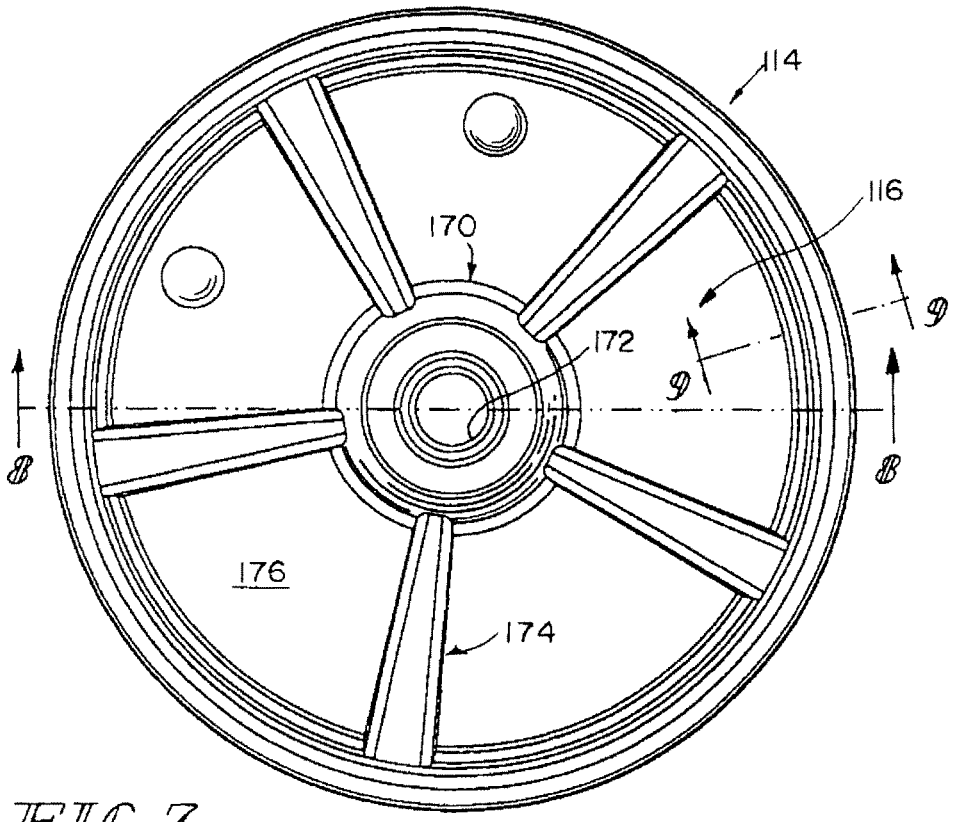
FIG. 7 is a top plan view of a lid in accordance with a second embodiment of the present disclosure.
Figure 8:
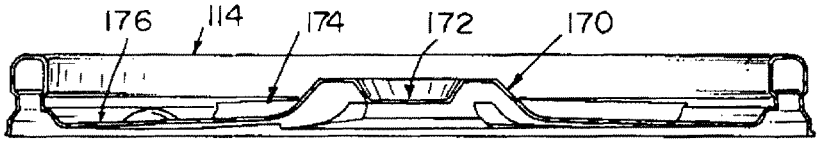
FIG. 8 is a sectional view taken along line 8-8 of FIG. 7.
Figure 9:
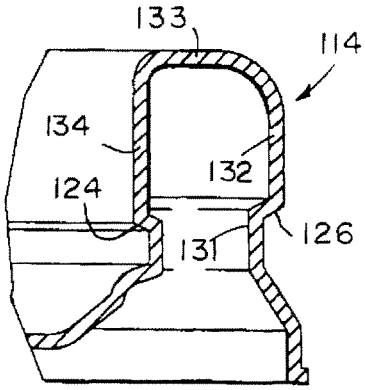
FIG. 9 is an enlarged view of a portion of the lid cross-section of FIG. 8.
Figure 10:
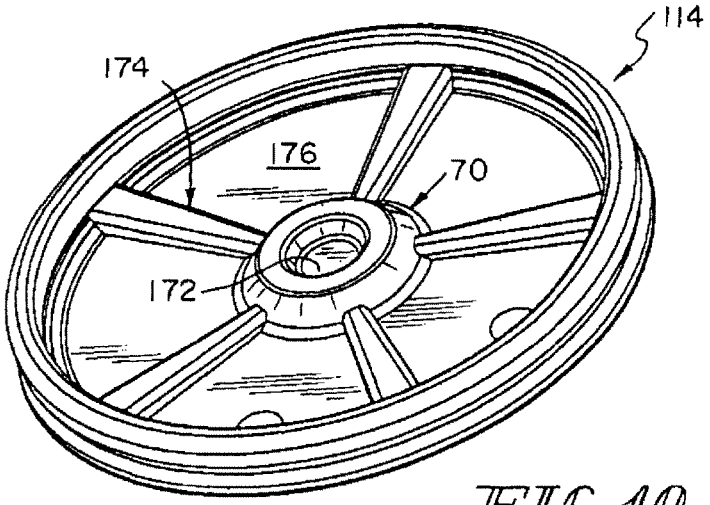
FIG. 10 is a perspective view of the lid of FIG. 7.
Figure 11:
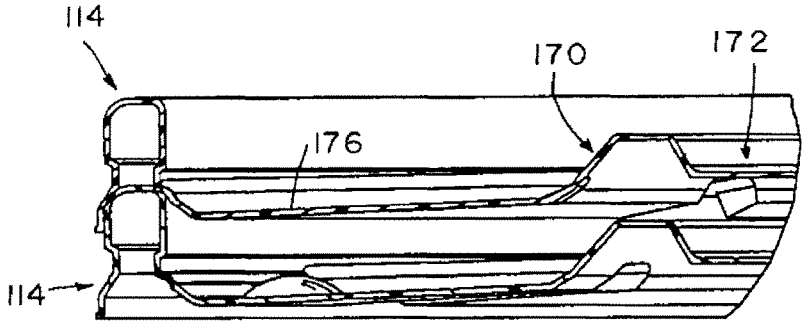
FIG. 11 is a sectional view (similar to FIG. 8) showing a stack comprising two of the lids shown in FIGS. 7 and 10.

In illustrative embodiments, retainers 24, 26 included in lid 14 are arranged to engage portions of cup 12 to block unwanted removal of lid 14 from cup 12 as suggested in FIGS. 5 and 6. Also in illustrative embodiments, four seal rings 31, 32, 33, and 34 are provided on lid 14 to engage companion annular seal surfaces 41, 42, 43, and 44 on cup 12 to establish four liquid flow barriers arranged in series near and on brim 20 to block unwanted discharge of liquid from liquid reservoir chamber 22 while lid 14 is in place on cup 12 as suggested in FIGS. 5 and 6.

As shown in FIG. 1, cup 12 includes brim 20, a floor 28, and a side wall 40 extending from brim 20 to floor 28. Side wall 40 is formed to include a large-diameter top portion 46 appended to brim 20, a small-diameter bottom portion 48, and a body portion 50 located between top and bottom portions 46, 48 as shown in FIG. 1. Side wall 40 also includes an annular top transitional portion 52 interconnecting top portion 46 and body portion 50 as shown, for example, in FIGS. 5 and 6. Side wall 40 also includes a "scalloped" annular bottom transitional portion 54 interconnecting body portion 50 and bottom portion 48 as suggested in FIG. 1.

As shown, for example, in FIG. 5, brim 20 includes, in series, a lid retainer 56, an inner annular strip 58, an annular bridge 60, and an outer annular strip 62. Lid retainer 56 is rooted to an upper portion of top portion 46 to anchor brim 20 to top portion 46. Outer annular strip 62 is oriented to lie in concentric relation to inner annular strip 58 and annular bridge 60 extends horizontally to link inner and outer annular strips 58, 62 as suggested in FIG. 5. Strips 58, 62 and bridge 60 cooperate to form a downwardly opening annular channel 64 above an exterior surface of lid retainer 56 in the illustrated embodiment. Outer annular strip 62 includes an axially downwardly facing annular terminal end 63.

Brim 20 is configured to form several seal surfaces arranged to mate with companion portions of lid 14 as suggested in FIGS. 5 and 6. Large-diameter top portion 46 includes radially inwardly facing first annular seal surface 41. Inner annular strip 58 includes second radially inwardly facing second annular seal surface 42. Annular bridge 60 includes axially upwardly facing third annular seal surface 43. Outer annular strip 62 includes radially outwardly facing fourth annular seal surface 44.

Lid retainer 56 is a frustoconical segment in the illustrated embodiment and extends from top portion 46 to inner annular strip 58 in a radially inwardly projecting, axially outwardly extending direction as shown in FIGS. 5 and 6. Lid retainer 56 is arranged to converge toward a reference point (not shown) located along reference line 57 and in spaced-apart relation to floor 28 to position lid retainer 56 therebetween to provide an undercut 59 under inner annular strip 58 as suggested in FIGS. 5 and 6. Annular terminal end 63 of outer annular strip 62 is arranged to extend around frustoconical lid retainer 56 as suggested in FIGS. 5 and 6.

Figure 2:
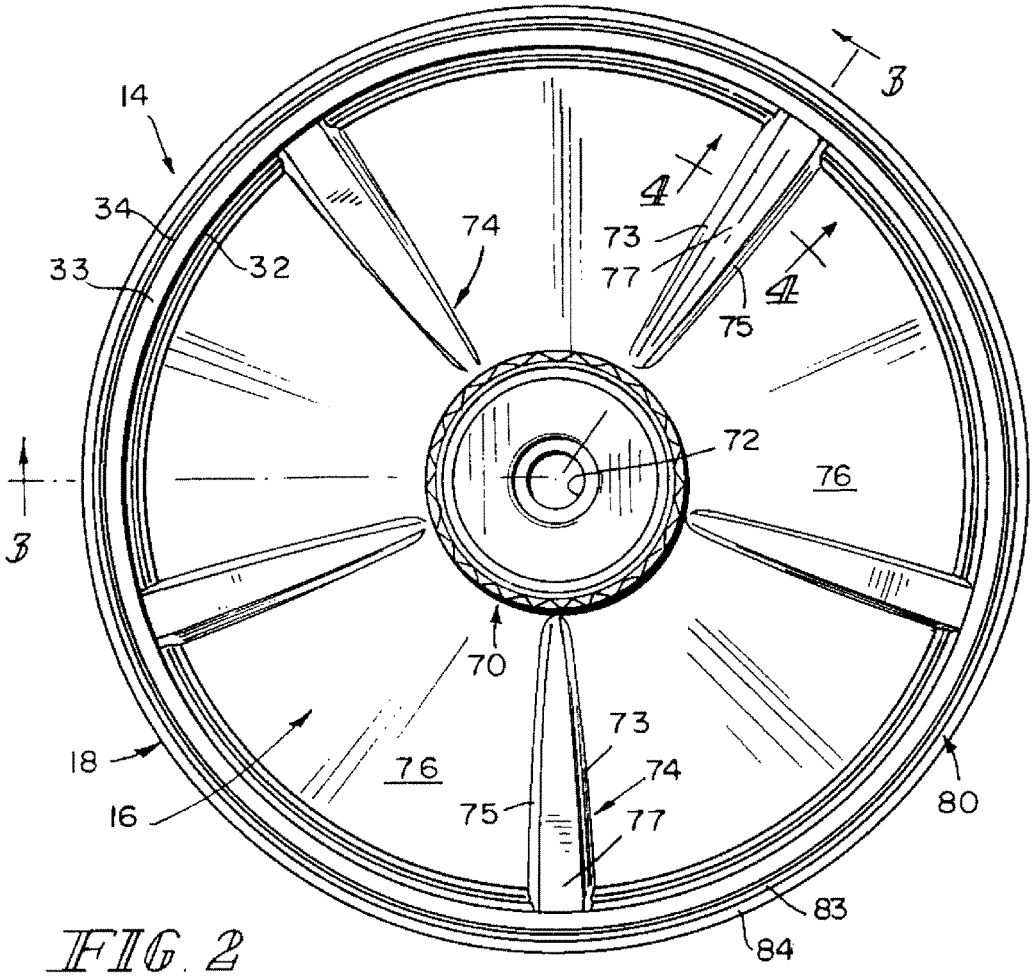
FIG. 2 is a top plan view of the lid of FIG. 1 showing a closure including a round hub providing a straw receiver, five radially extending spoke ribs terminating at the hub, and an inclined plate located between each pair of adjacent spoke ribs and showing a closure mount ring encircling the spoke ribs and inclined plates.
Figure 4:
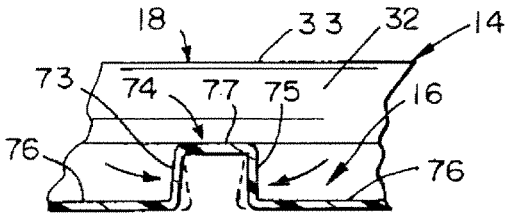
FIG. 4 is a transverse sectional view taken along line 4-4 of FIG. 2 showing one of the spoke ribs (in solid) when the lid is mounted on the cup as shown in FIG. 6 and showing deformation of that spoke rib (in phantom) of the type that would occur during mounting of the lid on the brim of the cup.

As shown in FIGS. 1 and 2, closure 16 of lid 14 includes a round hub 70 providing a straw receiver 72, five radially extending spoke ribs 74 terminating at hub 70, and an inclined plate 76 located between each pair of adjacent spoke ribs 74. In the illustrated embodiment, closure mount 18 is ring-shaped and arranged to encircle radially outermost portions of spoke ribs 74 and inclined plates 76. Each spoke rib 74 includes first and second side walls 73, 75 and a top wall 77 interconnecting side walls 73, 75 as suggested in FIGS. 2 and 4. Deformation of side walls 73, 75 of one of spoke ribs 74 during mounting of lid 14 on brim 20 of cup 12 is shown in phantom in FIG. 4.

Retainer 24 in lid 14 is defined by an annular first lid-removal blocker wall located between and arranged to interconnect first and second seal rings 31, 32. First lid-removal blocker wall 24 is arranged to engage frustoconical lid retainer 56 during movement of lid 14 in an outer direction 78 (see FIG. 6) away from floor 28 of cup 12 to block unwanted removal of lid 14 from cup 12. In the illustrated embodiment, first lid-removal blocker wall 24 has a frustoconical shape. First lid-removal blocker wall 24 is configured to diverge in direction 79 toward floor 28 of cup 12 as suggested, for example, in FIG. 6. First lid retainer 56 is arranged to lie above and in confronting relation to first lid-removal blocker wall 24 when closure mount 18 is coupled to brim 20 as suggested, for example, in FIG. 6. As suggested in FIG. 4, first seal ring 31 has a larger diameter than second seal ring 32.

Closure mount 18 further includes an annular lid-removal flange 80 located below fourth seal ring 34 and arranged to extend downwardly in an inner direction 79 opposite to outer direction 78. Retainer 26 included in lid 14 forms a part of closure mount 18 and is formed to provide a second lid-removal blocker wall. This second lid-removal blocker wall 26 is arranged to engage terminal end 63 of brim 20 during movement of lid 14 in outer direction 78 to block unwanted removal of lid 14 from cup 12.

Lid-removal flange 80 includes, in series, first, second, third, and fourth annular segments 81, 82, 83, and 84 as shown in detail in FIGS. 5 and 6. Second lid-removal blocker wall 26 has a frustoconical shape and is arranged to interconnect first annular segment 81 of lid-removal flange 80 and fourth seal ring 34 of closure mount 18. Each of the segments have frustoconical shapes of various slopes. Second lid-removal blocker wall 26 is configured to converge in direction 79 toward floor 28 of cup 12 as suggested, for example, in FIG. 6.

First annular segment 81 is arranged to surround first seal ring 31 to define an annular channel 85 therebetween. When lid 14 is mounted on brim 20 of cup 12, radially inwardly facing first annular seal surface 41 is located in annular channel 85 as shown, for example, in FIG. 6.

Referring to the illustration of closure mount 18 in FIG. 5, fourth seal ring 34 is aligned in concentric relation with second seal ring 32. The diameter of fourth seal ring 34 is greater than the diameters of first and second seal rings 31, 32. Closure mount 18 also includes an annular quarter round-shaped inner rim 86 interconnecting second and third seal rings 32, 33 and an annular quarter round-shaped outer rim 88 interconnecting third and fourth seal rings 33, 34 as suggested in FIG. 5. Second, third, and fourth seal rings 32, 33, 34 cooperate to define an annular chamber 89 communicating with annular channel 85 and receiving brim 20 therein when lid 14 is mounted on cup 12 as suggested in FIG. 6.

Figure 3:
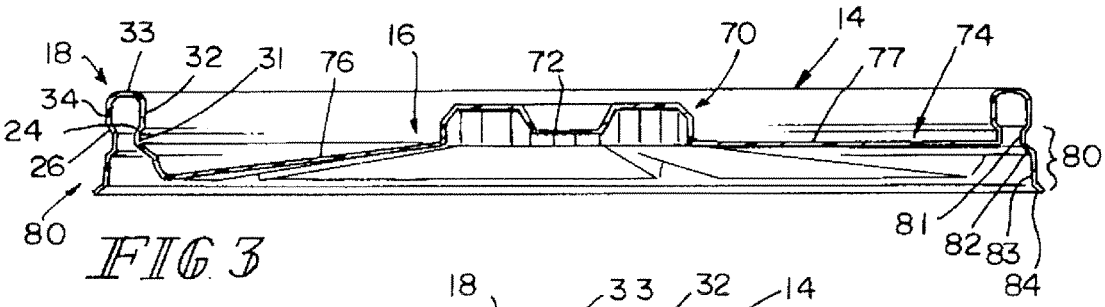
FIG. 3 is a sectional view of the lid taken along line 3-3 of FIG. 2 showing the configuration of a downwardly opening annular brim receiver defined by the closure mount ring and sized to receive an annular brim of the cup therein as suggested in FIGS. 5 and 6.

Closure 16 includes a peripheral portion comprising outer frustoconical wall 90 appended to first seal ring 31, inner frustoconical wall 91 appended to inclined plates 76, and middle frustoconical wall 92 arranged to interconnect outer and inner frustoconical walls 90, 91 as shown in FIGS. 1, 3, and 5. These walls 90-92 cooperate to support inclined plates 76 as suggested in the drawings.

The slope of inclined plates 76 provided in lid 14 increases once lid 14 is mounted on cup 12. Owing, in part, to configuration of walls 90-92, a first of inclined plates 76 has a first slope (defined by first acute angle 93) with respect to a horizontal reference plane 94 before closure mount 18 is mounted on brim 20 of cup 12 as suggested in FIG. 5. That inclined plate 76 is moved to assume a steeper second slope (defined by second acute angle 95) with respect to horizontal reference plane 94 upon coupling of closure mount 18 on brim 20 as suggested in FIG. 6. As lid 14 is mounted on brim 20 of cup 12, dimension 100 between radially outwardly facing surfaces of first seal ring 31 and first annular segment 81 will increase as suggested by greater dimension 101 owing, in part, to dimension 102 between radially outwardly facing fourth annular seal surface 44 and radially outwardly facing surface of top portion 46 since dimension 102 is greater than dimension 100.

Lid 114 shown, for example, in FIGS. 7-12, incorporated many of the features associated with lid 14 shown, for example, in FIGS. 1-6. Retainers 124, 126 included in lid 114 are arranged to engage portions of cup 112 to block unwanted removal of lid 114 from cup 112 as suggested in FIG. 12. Four seal rings 131, 132, 133, and 134 are provided on lid 114 to engage companion annular seal surfaces 141, 142, 143, and 144 on cup 112 to establish four liquid flow barriers arranged in series near and on brim 120 of cup 112 to block unwanted discharge of liquid from a liquid reservoir chamber 122 in cup 112 while lid 114 is in place on cup 112 as suggested in FIG. 12.

Figure 12:
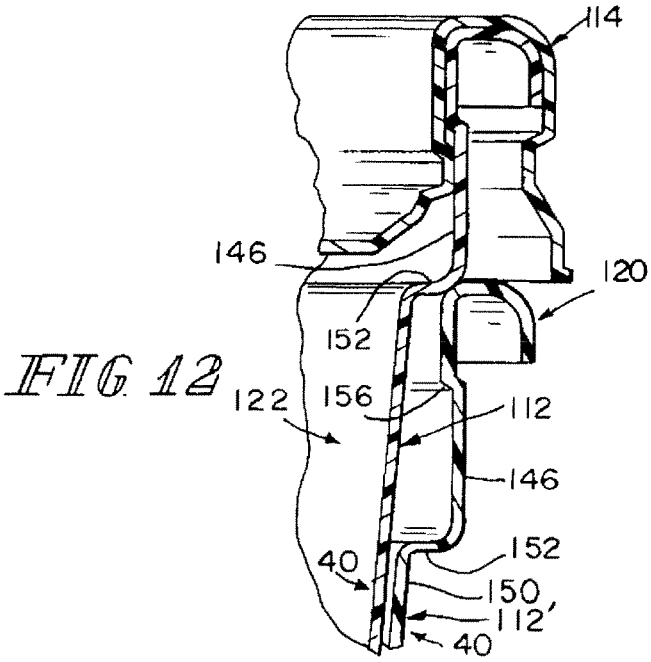
FIG. 12 is a partial sectional view showing a lid of the type shown in FIGS. 7-11 mounted on a first cup that is nested in an underlying second cup.

As shown, for example, in FIG. 12, cup 112 includes brim 120 and a side wall 140 extending downwardly from brim 120. Side wall 140 is formed to include a large-diameter top portion 146 appended to brim 120, a body portion 150 located under top portion 146, and an annular transitional portion 152 interconnecting top portion 146 and body portion 150. Brim 120 also includes a lid retainer 156 as suggested in FIG. 12.

Closure 116 of lid 114 includes a round hub 170 providing a straw receiver 172 and five radically extending spoke ribs 174 terminating at hub 170. Closure 116 also includes an inclined plate 176 located between each pair of adjacent spoke ribs 174. Lid 114 also includes a lid-removal flange 180 as suggested in FIGS. 8, 9, and 12

Figure 13:
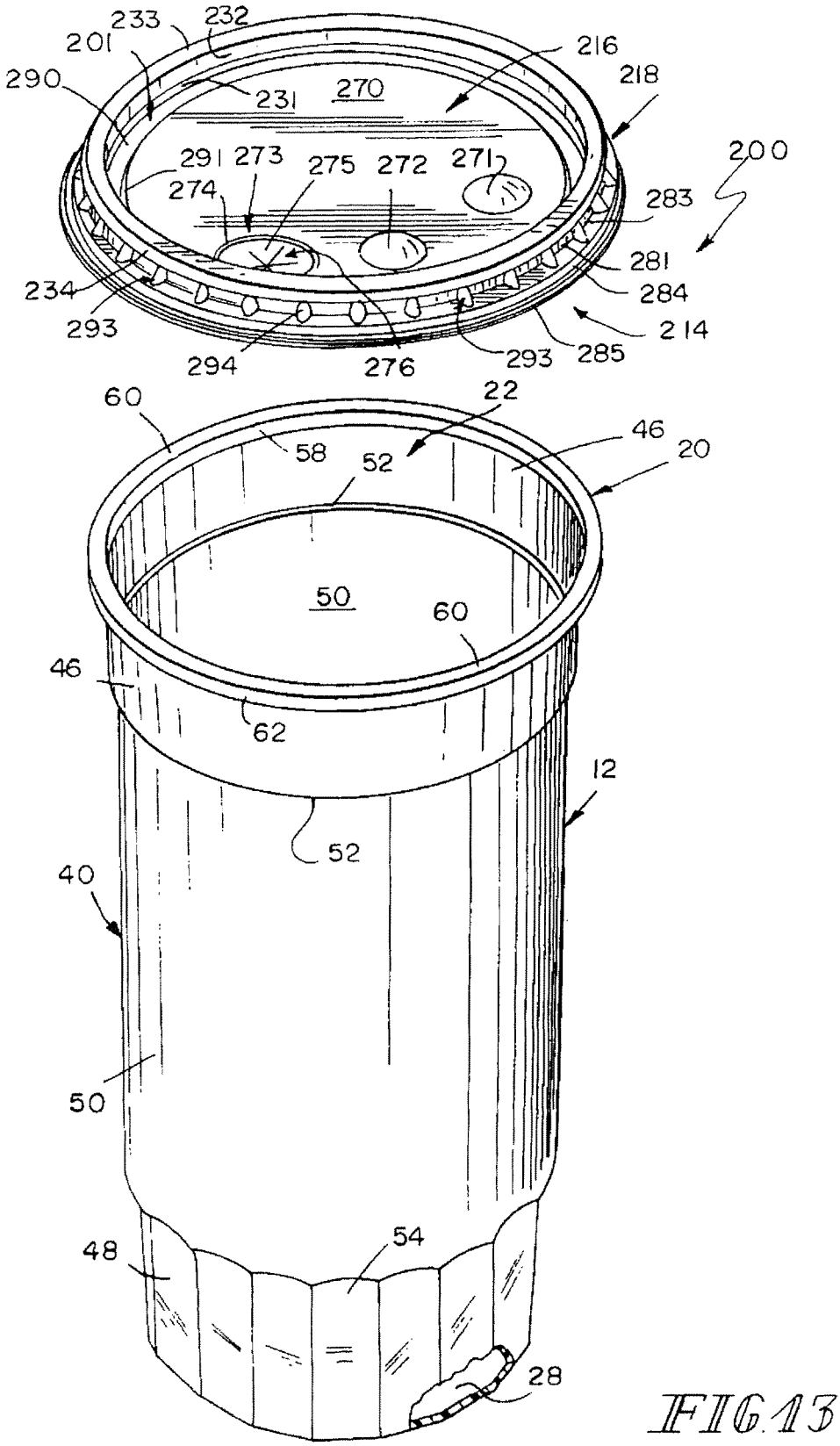
FIG. 13 is a perspective view of a lid in accordance with a third embodiment of the present disclosure and a cup before the lid is mounted on the cup.

A liquid container 200 includes a cup 12 and a lid 214 in accordance with a third embodiment of the present disclosure as shown in FIG. 13. Lid 214 includes a closure 216 and a fluted closure mount 218 configured to be mounted on a brim 20 of cup 12 to arrange closure 216 to close an opening into a liquid reservoir chamber 22 formed in cup 12 as suggested in FIG. 17.

Figure 16:
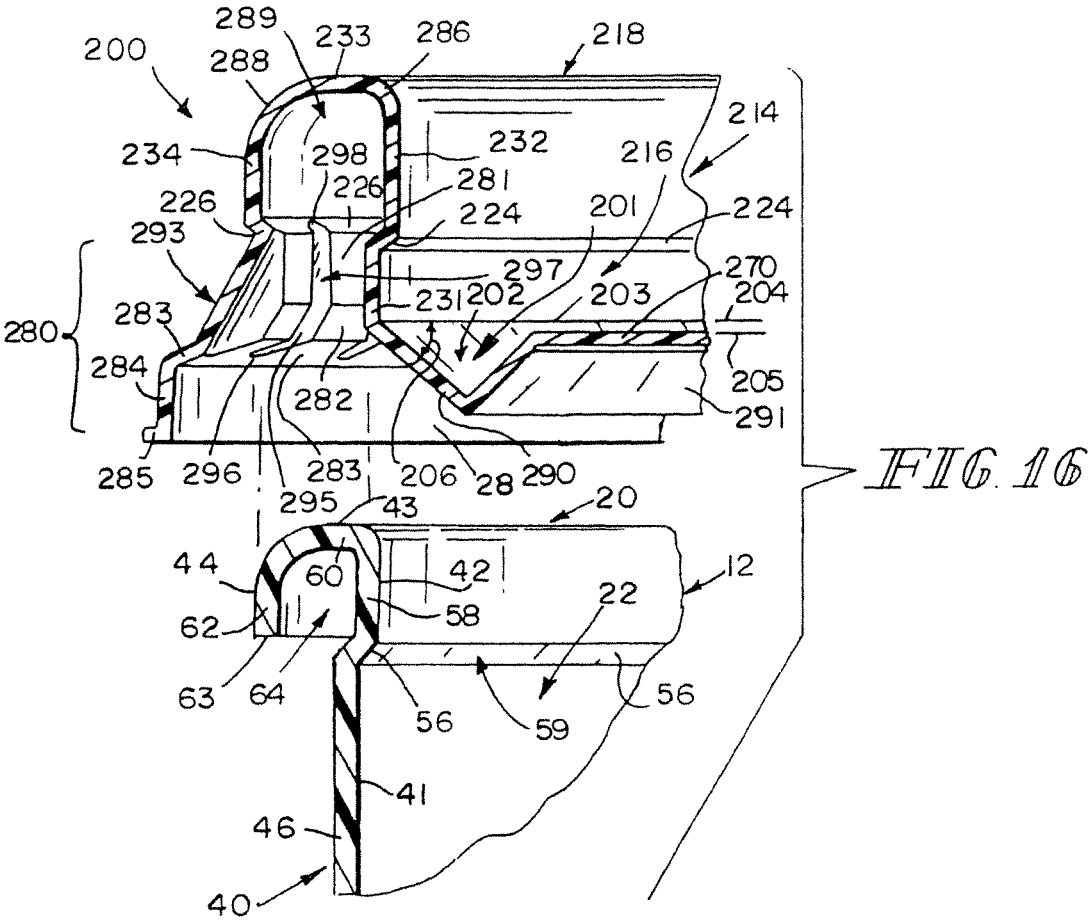
FIG. 16 is an enlarged sectional view of portions of the lid and cup of FIG. 13 before the lid is mounted on the cup.
Figure 17:
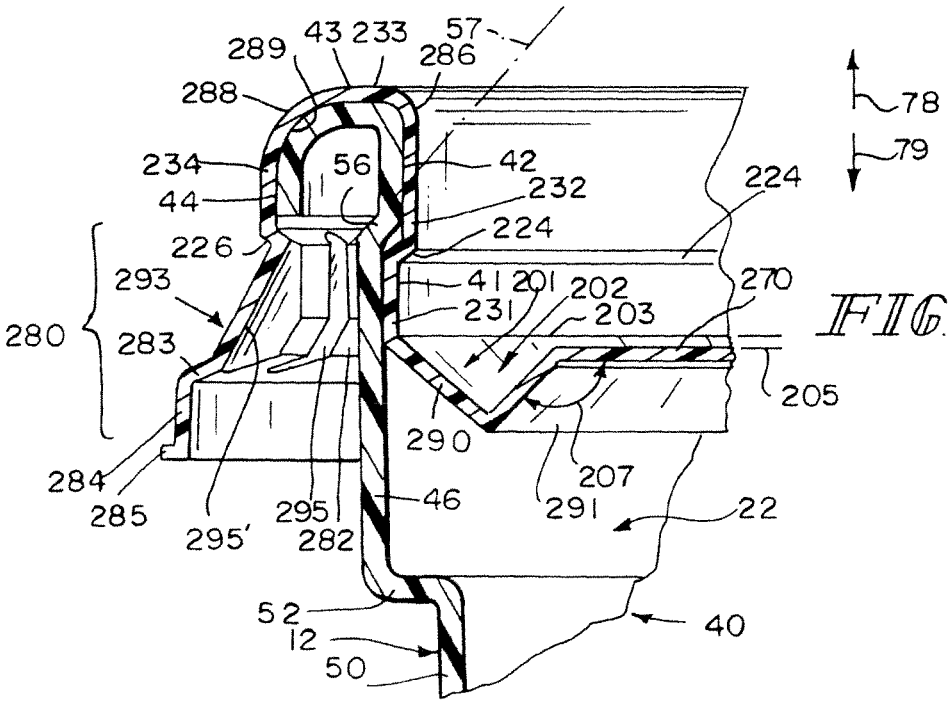
FIG. 17 is a view similar to FIG. 16 after the lid is mounted on the cup showing formation of a series of liquid flow barriers to retain liquid in a reservoir chamber formed in the cup owing to sealing engagement between the closure mount ring of the lid and both of a side wall and the brim of the cup, also showing retention of the lid on the cup owing, in part, to engagement of a portion of the lid in an "undercut" formed on an interior surface of the cup at a junction between the side wall and the brim of the cup, and further showing that the lid includes a fluted closure mount ring including an annular lid-removal flange arranged to extend downwardly from the brim of the cup and formed to include a series of circumferentially spaced-apart radially inwardly opening channels facing toward an exterior surface of the side wall of the cup.

In illustrative embodiments, retainers 224, 226 included in lid 214 are arranged to engage portions of cup 12 to block unwanted removal of lid 214 from cup 12 as suggested in FIGS. 16 and 17. Also in illustrative embodiments, four seal rings 231, 232, 233, and 234 are provided on lid 214 to engage companion annular seal surfaces 41, 42, 43, and 44 on cup 12 to establish four liquid flow barriers arranged in series near and on brim 20 to block unwanted discharge of liquid from liquid reservoir chamber 22 while lid 214 is in place on cup 12 as suggested in FIGS. 16 and 17.

As shown in FIG. 13, cup 12 includes brim 20, a floor 28, and a side wall 40 extending from brim 20 to floor 28. Side wall 40 is formed to include a large-diameter top portion 46 appended to brim 20, a small-diameter bottom portion 48, and a body portion 50 located between top and bottom portions 46, 48 as shown in FIG. 13. Side wall 40 also includes an annular top transitional portion 52 interconnecting top portion 46 and body portion 50 as shown, for example, in FIGS. 16 and 17. Side wall 40 also includes a "scalloped" annular bottom transitional portion 54 interconnecting body portion 50 and bottom portion 48 as suggested in FIG. 13.

As shown, for example, in FIG. 16, brim 20 includes, in series, a lid retainer 56, an inner annular strip 58, an annular bridge 60, and an outer annular strip 62. Lid retainer 56 is rooted to an upper portion of top portion 46 to anchor brim 20 to top portion 46. Outer annular strip 62 is oriented to lie in concentric relation to inner annular strip 58 and annular bridge 60 extends horizontally to link inner and outer annular strips 58, 62 as suggested in FIG. 13. Strips 58, 62 and bridge 60 cooperate to form a downwardly opening annular channel 64 above an exterior surface of lid retainer 56 in the illustrated embodiment. Outer annular strip 62 includes an axially downwardly facing annular terminal end 63.

Brim 20 is configured to form several seal surfaces arranged to mate with companion portions of lid 214 as suggested in FIGS. 16 and 17. Large-diameter top portion 46 includes radially inwardly facing first annular seal surface 41. Inner annular strip 58 includes second radially inwardly facing second annular seal surface 42. Annular bridge 60 includes axially upwardly facing third annular seal surface 43. Outer annular strip 62 includes radially outwardly facing fourth annular seal surface 44.

Lid retainer 56 is a frustoconical segment in the illustrated embodiment and extends from top portion 46 to inner annular strip 58 in a radially inwardly projecting, axially outwardly extending direction as shown in FIGS. 16 and 17. Lid retainer 56 is arranged to converge toward a reference point (not shown) located along reference line 57 and in spaced-apart relation to floor 28 to position lid retainer 56 therebetween to provide an undercut 59 under inner annular strip 58 as suggested in FIGS. 16 and 17. Annular terminal end 63 of outer annular strip 62 is arranged to extend around frustoconical lid retainer 56 as suggested in FIGS. 16 and 17.

Figure 14:
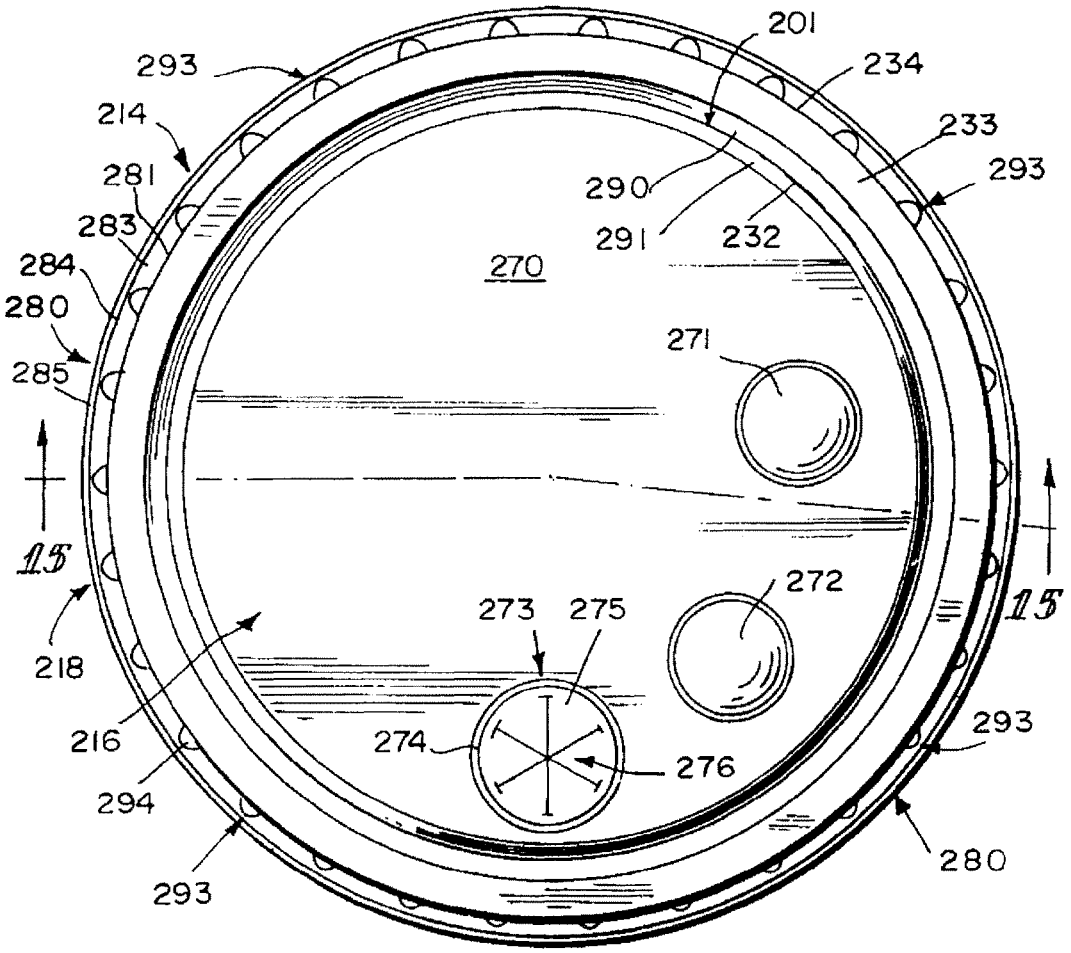
FIG. 14 is a top plan view of the lid of FIG. 13 showing a closure including a round plate formed to include a straw receiver and two separate deformable drink-identification domes and showing a closure mount ring encircling the round plate.

As shown in FIGS. 13 and 14, closure 216 of lid 214 includes a round plate 270 formed to include deformable first and second product-identification domes 271, 272 and a liquid-dispenser zone 273. Liquid-dispenser zone 273 includes a round perimeter wall 274 bounding a land 275 formed to include a straw receiver 276. In the illustrated embodiment, closure mount 18 is ring-shaped and arranged to encircle round plate 270.

Retainer 224 in lid 214 is defined by an annular first lid-removal blocker wall located between and arranged to interconnect first and second seal rings 231, 232. First lid-removal blocker wall 224 is arranged to engage frustoconical lid retainer 56 during movement of lid 214 in an outer direction 78 (see FIG. 17) away from floor 28 of cup 12 to block unwanted removal of lid 214 from cup 12. In the illustrated embodiment, first lid-removal blocker wall 224 has a frustoconical shape. First lid-removal blocker wall 224 is configured to diverge in direction 79 toward floor 28 of cup 12 as suggested, for example, in FIG. 17. First lid retainer 56 is arranged to lie above and in confronting relation to first lid-removal blocker wall 224 when closure mount 218 is coupled to brim 20 as suggested, for example, in FIG. 17. As suggested in FIG. 15, first seal ring 231 has a larger diameter than second seal ring 232.

Closure mount 218 further includes an annular lid-removal flange 280 located below fourth seal ring 234 and arranged to extend downwardly in an inner direction 79 opposite to outer direction 78. Closure mount 218 is fluted in the embodiment shown in FIGS. 13-20 owing to the formation of radially inwardly facing grooves 297 in protuberances 293 provided in annular lid-removal flange 280 as shown, for example, in FIGS. 16-19.

Retainer 226 included in lid 214 forms a part of fluted closure mount 218 and is formed to provide a second lid-removal blocker wall. This second lid-removal blocker wall 226 is arranged to engage terminal end 63 of brim 20 during movement of lid 214 in outer direction 78 to block unwanted removal of lid 214 from cup 12. In the illustrated embodiment, second lid-removal blocker wall 226 has a frustoconical shape.

Lid-removal flange 280 includes, in series, first, second, third, fourth, and fifth annular segments 281, 282, 283, 284, and 285 as shown in detail in FIGS. 15-20. Second lid-removal blocker wall 226 has a frustoconical shape and is arranged to interconnect first annular segment 281 of lid-removal flange 280 and fourth seal ring 234 of closure mount 218. Each of the segments have frustoconical shapes of various slopes. Second lid-removal blocker wall 226 is configured to converge in direction 79 toward floor 28 of cup 12 as suggested, for example, in FIG. 17.

First annular segment 281 is arranged to surround first seal ring 231 to define an annular channel therebetween. When lid 214 is mounted on brim 20 of cup 12, radially inwardly facing first annular seal surface 241 is located in this annular channel as shown, for example, in FIG. 17.

Referring to the illustration of closure mount 218 in FIG. 16, fourth seal ring 234 is aligned in concentric relation with second seal ring 232. The diameter of fourth seal ring 234 is greater than the diameters of first and second seal rings 231, 232. Closure mount 218 also includes an annular quarter round-shaped inner rim 286 interconnecting second and third seal rings 232, 233 and an annular quarter round-shaped outer rim 288 interconnecting third and fourth seal rings 233, 234 as suggested in FIG. 16. Second, third, and fourth seal rings 232, 233, 234 cooperate to define an annular chamber 289 communicating with the annular channel defined between first annular segment 281 and first seal ring 231 and receiving brim 20 therein when lid 214 is mounted on cup 12 as suggested in FIGS. 16 and 17.

Figure 15:
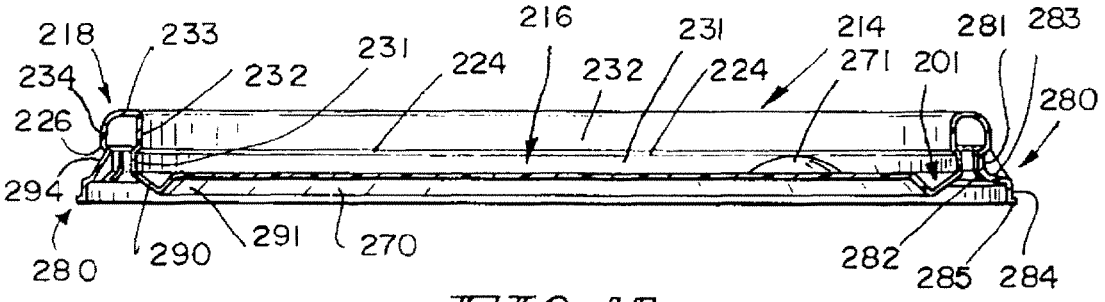
FIG. 15 is a sectional view of the lid taken along line 15-15 of FIG. 14 showing the configuration of a downwardly opening annular brim receiver defined by the closure mount ring and sized to receive an annular brim of the cup therein as suggested in FIGS. 16 and 17.

Closure 216 includes a peripheral portion 201 comprising outer frustoconical wall 290 appended to first seal ring 231 and inner frustoconical wall 291 appended to round plate 270 and surrounded by outer frustoconical wall 290 as shown in FIGS. 13, 15, and 16. These walls 290 and 291 cooperate to support round plate 270 as suggested in the drawings. Peripheral portion 201 has a V-shaped cross section as shown, for example, in FIGS. 16 and 17 and surrounds round plate 270 and mates with first seal ring 231. Inner frustoconical wall 291 cooperates with outer frustoconical wall 290 to define a channel 202 having a top opening facing away from floor 28 of cup 12 as suggested in FIGS. 13, 16, and 17.

Outer frustoconical wall 290 mates with first seal ring 231 at a circular edge 203 lying in a first plane 204 and round plate 270 lies in a second plane 205 located between first plane 204 and floor 28 of cup 12 as suggested in FIG. 17. Outer frustoconical wall 290 cooperates with first plane 270 to define an obtuse included angle 207 therebetween of about 137°.

Figure 20:
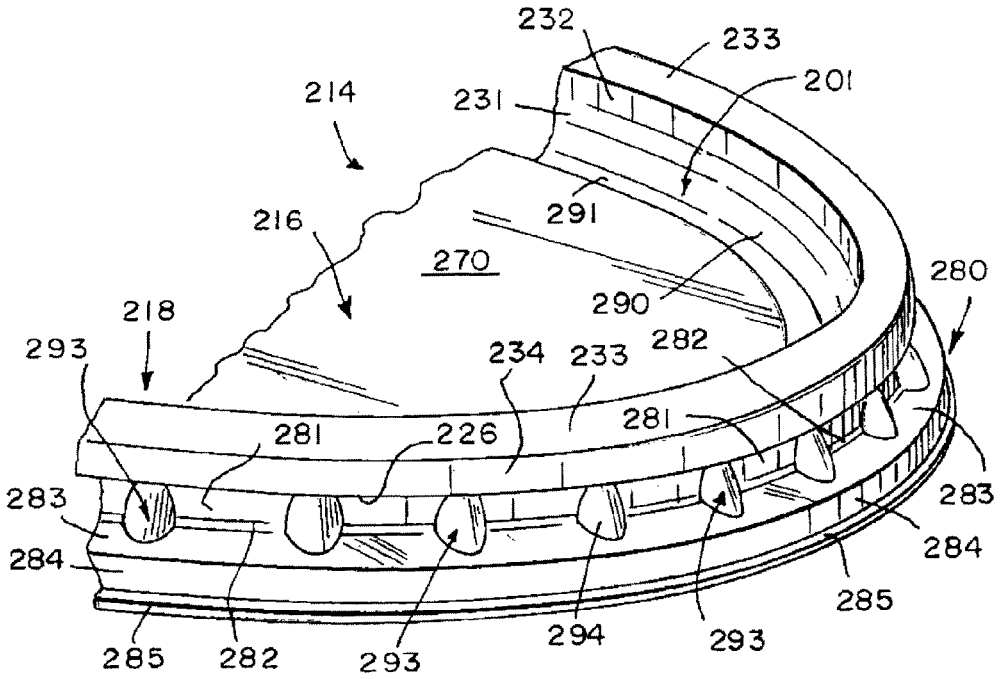
FIG. 20 is an enlarged perspective view of a portion of the lid of FIGS. 13-20 showing a series of radially outwardly projecting and circumferentially spaced-apart protuberances formed in the annular lid-removal flange of the fluted closure mount ring wherein each of the protuberances has a radially inwardly facing interior surface defining one of the channels included in the annular lid-removal flange.

As shown best in FIGS. 13, 14, and 20, fluted closure mount 218 of lid 214 further includes a series of circumferentially spaced-apart protuberances 293. Each protuberance 293 is arranged to extend upwardly from third annular segment 283 to annular retainer 226. In an illustrative embodiment, each protuberance 293 is characterized by a convex, rounded outer surface 294 that is arranged to face away from top portion 46 of side wall 40 when lid 214 is mounted on brim 20 of cup 12 and a concave, rounded inner surface 295 that is arranged to face toward top portion 46 when lid 214 is mounted on brim 20.

Figure 18:
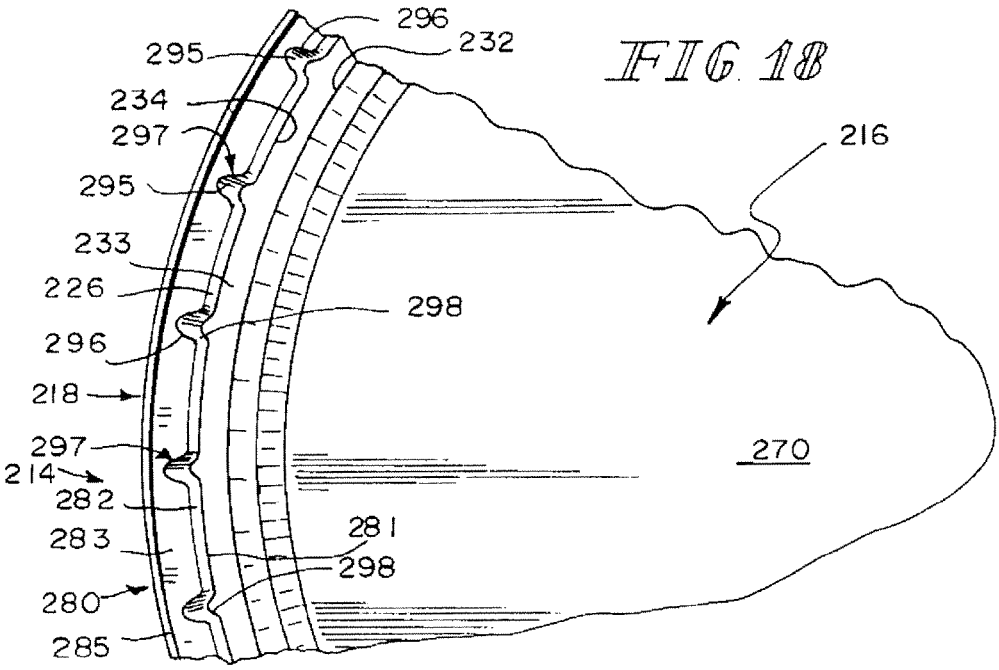
FIG. 18 is an enlarged partial bottom view of the lid of FIGS. 13-17 showing five of the circumferentially spaced-apart channels formed in the annular lid-removal flange.
Figure 19:
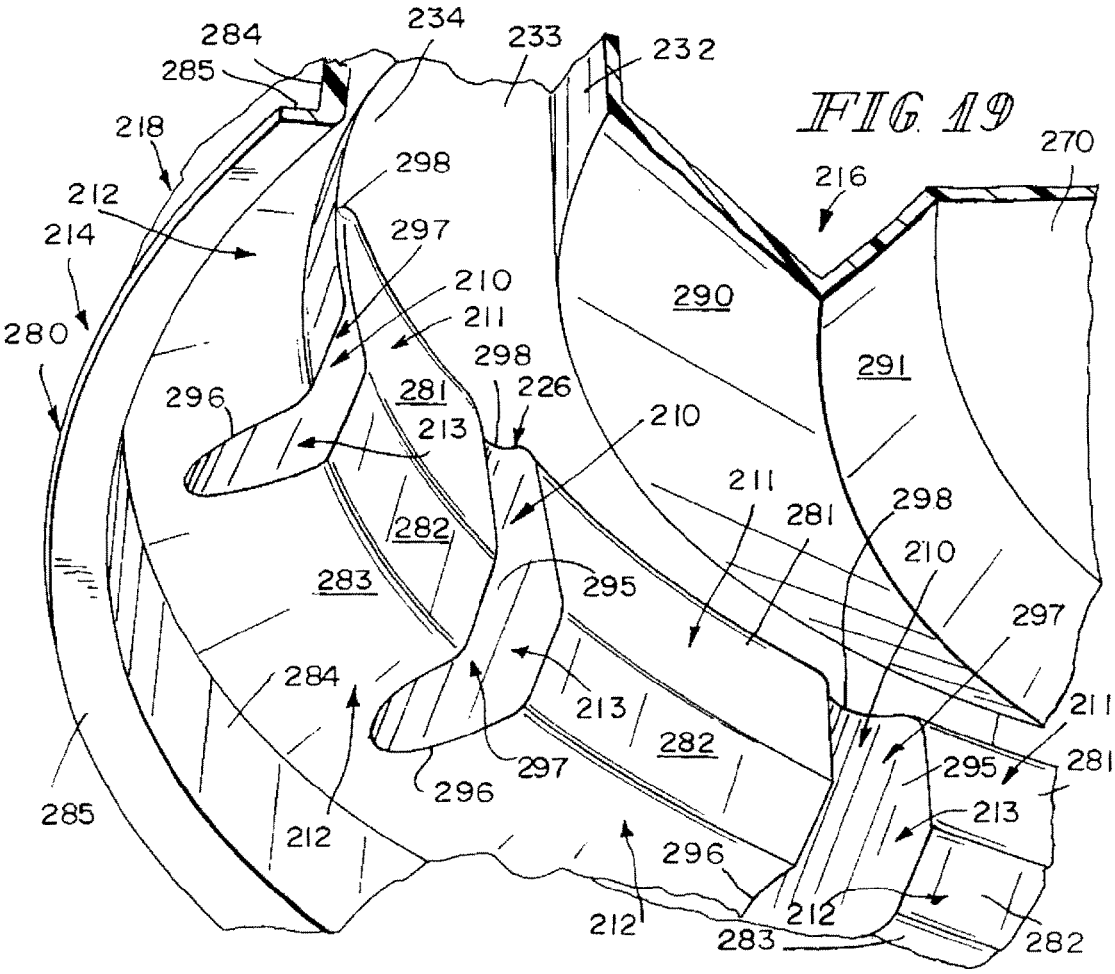
FIG. 19 is a highly enlarged, fragmented, perspective view of a portion of the underside of the lid of FIG. 18 showing three of the channels formed in the annular lid-removal flange.

As shown best in FIGS. 18 and 19, third annular segment 283 in closure mount 218 includes a U-shaped edge 296 associated with each protuberance 293 and formed to define a bottom opening into an interior region or groove 297 bounded by concave, rounded inner surface 295 of a companion protuberance 293. Likewise, second lid-removal blocker wall 226 is formed to include a more shallow U-shaped edge 298 associated with each protuberance 293 and formed to define a top opening into the companion interior region 297. As shown, for example, in FIG. 19, first and second annular segments 281, 282 are interrupted by interior regions 297 of protuberances 293. In the illustrated embodiment, closure mount 218 is fluted in that it is marked by a series of radially inwardly facing grooves 297 defined by concave, rounded inner surfaces 295 of protuberances 293.

Lid-removal flange 280 includes, in series, a first annular segment 281 coupled to lid-removal blocker wall 226, a second annular segment 282, and a third annular segment 283 consistent with a first perspective of lid-removal flange 280, the first and second annular segments 281, 282 being formed to include protuberances 293. Each protuberance 293 includes an upper end mating with second lid-removal blocker wall 226 and a lower end mating with third annular segment 283 as shown best in FIGS. 15 and 20. Lid-removal blocker wall 280 includes a U-shaped edge 298 associated with the upper end of each protuberance 293 and formed to define a top opening into the radially inwardly facing groove 297 formed in said each protuberance 293 as suggested in FIGS. 16-20. Third annular segment 283 includes a U-shaped edge 296 associated with the lower end of each protuberance 293 and formed to define a bottom opening into the radially inwardly facing groove 297 formed in said each protuberance 293.

Consistent with a second perspective of lid-removal flange 280, first annular segment 281 includes a series of spaced-apart first arcuate elements 211 arranged in a ring-shaped formation to define a first protuberance-receiving space 210 between each pair of adjacent first arcuate elements 211. Second annular segment 282 includes a series of spaced-apart second arcuate elements 212 arranged in a ring-shaped formation to define a second protuberance-receiving space 213 between each pair of adjacent second arcuate elements 212. Each protuberance 293 is located in an aligned pair of companion first and second protuberance-receiving spaces 210, 213 and coupled to each of the first and second arcuate elements 211, 212 cooperating to define said aligned pair of companion first and second protuberance-receiving spaces 210, 213. First annular segment 281 has a cylindrical shape, second annular segment 282 has a first frustoconical shape characterized by a steep slope, and third annular segment 283 has a second frustoconical shape characterized by a slope that is less steep than the steep slope of the first frustoconical shape of second annular segment 282 as suggested in FIG. 15. Lid-removal blocker wall 226 has a third frustoconical shape.

Fourth seal ring 284 is arranged to extend in a vertical direction when fluted closure mount ring 218 is coupled to brim 20 of cup 12 as shown in FIG. 17. At least a portion 295' of concave, rounded inner surface 295 of protuberance 293 is inclined to slope in a downwardly and radially outwardly extending direction relative to fourth seal ring 284 as also shown in FIG. 17. At least a portion 294' of the concave, rounded outer surface 294 is inclined to slope in a downwardly and radially outwardly extending direction relative to fourth seal ring 284 as shown in FIG. 17.

The invention claimed is:

1. A liquid container comprising a cup including a brim, a floor, and a side wall extending from the brim toward the floor, the side wall including a radially inwardly facing first annular seal surface, the brim including a radially inwardly facing second annular seal surface, an axially upwardly facing third annular seal surface, and a radially outwardly facing fourth annular seal surface, and a downwardly opening channel between the second annular seal surface and the fourth annular seal surface, and a lid including a closure and a fluted closure mount ring appended to the closure and coupled to the brim to retain the closure in a position closing a mouth opening into a liquid reservoir chamber formed in the cup, the fluted closure mount ring including a first seal ring arranged to engage the radially inwardly facing first annular seal surface to establish a first liquid flow barrier therebetween, a second seal ring arranged to engage the radially inwardly facing second annular seal surface to establish a second liquid flow barrier therebetween, a third seal ring arranged to engage the axially upwardly facing third annular seal surface to establish a third liquid flow barrier therebetween, and a fourth seal ring arranged to engage the radially outwardly facing fourth annular seal surface to establish a fourth liquid flow barrier therebetween, wherein the fluted closure mount ring further includes a lid-removal flange located below the fourth seal ring and arranged to extend downwardly in an inner direction toward the floor of the cup, the lid-removal flange is formed to include a series of circumferentially spaced-apart, radially outwardly projecting protuberances arranged to underlie the fourth seal ring, and each protuberance of the fluted closure mount ring is formed to include a radially inwardly opening groove facing toward the side wall of the cup.

2. The liquid container of claim 1, wherein the lid-removal flange includes, in series, a first annular segment coupled to the fourth seal ring, a second annular segment, and a third annular segment, the first and second annular segments are formed to include the protuberances, and each protuberance includes an upper end coupled to the fourth seal ring and a lower end mating with the third annular segment.

3. The liquid container of claim 2, including a U-shaped edge associated with the upper end of each protuberance and formed to define a top opening into the radially inwardly facing groove formed in said each protuberance.

4. The liquid container of claim 2, wherein the third annular segment includes a U-shaped edge associated with the lower end of each protuberance and formed to define a bottom opening into the radially inwardly facing groove formed in said each protuberance.

5. The liquid container of claim 4, including a U-shaped edge associated with the upper end of each protuberance and formed to define a top opening into the radially inwardly facing groove formed in said each protuberance.

6. The liquid container of claim 1, wherein the lid-removal flange includes, in series, a first annular segment coupled to the fourth seal ring, a second annular segment, and a third annular segment, the first annular segment includes a series of spaced-apart first arcuate elements arranged in a ring-shaped formation to define a first protuberance-receiving space between each pair of adjacent first arcuate elements, the second annular segment includes a series of spaced-apart second arcuate elements arranged in a ring-shaped formation to define a second protuberance-receiving space between each pair of adjacent second arcuate elements, and each protuberance is located in an aligned pair of companion first and second protuberance-receiving spaces and coupled to each of the first and second arcuate elements cooperating to define said aligned pair of companion first and second protuberance-receiving spaces.

7. The liquid container of claim 6, wherein each protuberance includes an upper end coupled to the fourth seal ring and a lower end mating with the third annular segment.

8. The liquid container of claim 6, wherein the first annular segment has a cylindrical shape, the second annular segment has a first frustoconical shape characterized by a steep slope, and the third annular segment has a second frustoconical shape characterized by a slope that is less steep than the steep slope of the first frustoconical shape of the second annular segment.

9. The liquid container of claim 8, including a U-shaped edge associated with the upper end of each protuberance and formed to define a top opening into the radially inwardly facing groove formed in said each protuberance.

10. The liquid container of claim 8, wherein the third annular segment includes a U-shaped edge associated with the lower end of each protuberance and formed to define a bottom opening into the radially inwardly facing groove formed in said each protuberance.

11. The liquid container of claim 1, wherein each protuberance includes a concave, rounded inner surface that is configured to define the radially inwardly opening groove of said each protuberance.

12. The liquid container of claim 11, wherein the fourth seal ring is arranged to extend in a vertical direction when the fluted closure mount ring is coupled to the brim of the cup and at least a portion of the concave, rounded inner surface is inclined to slope in a downwardly and radially outwardly extending direction relative to the fourth seal ring.

13. The liquid container of claim 1, wherein each protuberance includes a concave, rounded outer surface that is configured to define the radially inwardly opening groove of said each protuberance.

14. The liquid container of claim 13, wherein the fourth seal ring is arranged to extend in a vertical direction when the fluted closure mount ring is coupled to the brim of the cup and at least a portion of the concave, rounded outer surface is inclined to slope in a downwardly and radially outwardly extending direction relative to the fourth seal ring.

15. The liquid container of claim 1, wherein the closure includes a round plate formed to include a liquid-dispenser zone and a peripheral portion having a V-shaped cross section and surrounding the round plate and mating with the first seal ring and wherein the peripheral portion includes an outer frustoconical wall coupled to the first seal ring and an inner frustoconical wall arranged to interconnect the outer frustoconical wall and the round plate and cooperate with the outer frustoconical wall to define a channel having a top opening facing away from the floor of the cup.

16. The liquid container of claim 15, wherein the outer frustoconical wall mates with the first seal ring at a circular edge lying in a first plane and the round plate lies in a second plane located between the first plane and the floor of the cup.

17. The liquid container of claim 16, wherein the outer frustoconical wall cooperates with the first plane to define an acute included angle therebetween of about 40°.

18. The liquid container of claim 16, wherein the inner frustoconical wall cooperates with the round plate to define an obtuse included angle therebetween of about 137°.

19. The liquid container of claim 18, wherein the outer frustoconical wall cooperates with the first plane to define an acute included angle therebetween of about 40°.

20. The liquid container of claim 1, wherein the brim includes an inner annular strip located above the side wall of the cup and a frustoconical lid retainer arranged to interconnect the inner annular strip and the side wall of the cup and to converge toward a reference point located in spaced-apart relation to the floor to position the frustoconical lid retainer therebetween to provide an undercut under the inner annular strip and the fluted closure mount ring includes a lid-removal blocker wall located between the first and second seal ring and arranged to engage the frustoconical lid retainer during movement of the lid in an outer direction away from the floor of the cup to block removal of the lid from the cup.

21. A liquid container comprising a cup including a brim, a floor, and a side wall extending from the brim toward the floor, the side wall including a radially inwardly facing first annular seal surface, the brim including a radially inwardly facing second annular seal surface, an axially upwardly facing third annular seal surface, and a radially outwardly facing fourth annular seal surface, and a downwardly opening channel between the second annular seal surface and the fourth annular seal surface, and a lid including a closure and a fluted closure mount ring appended to the closure and coupled to the brim to retain the closure in a position closing a mouth opening into a liquid reservoir chamber formed in the cup, the fluted closure mount ring including a first seal ring arranged to engage the radially inwardly facing first annular seal surface to establish a first liquid flow barrier therebetween, a second seal ring arranged to engage the radially inwardly facing second annular seal surface to establish a second liquid flow barrier therebetween, a third seal ring arranged to engage the axially upwardly facing third annular seal surface to establish a third liquid flow barrier therebetween, and a fourth seal ring arranged to engage the radially outwardly facing fourth annular seal surface to establish a fourth liquid flow barrier therebetween, wherein the fluted closure mount ring further includes a lid-removal flange located below the fourth seal ring and arranged to extend downwardly in an inner direction toward the floor of the cup, a lid-removal blocker wall located between the fourth seal ring and the lid-removal flange and arranged to engage a terminal end of the brim during movement of the lid in an outer direction opposite to the inner direction.

22. A liquid container comprising a cup including a brim, a floor, and a side wall extending from the brim toward the floor, the side wall including a radially inwardly facing first annular seal surface, the brim including a radially inwardly facing second annular seal surface, an axially upwardly facing third annular seal surface, and a radially outwardly facing fourth annular seal surface, and a downwardly opening channel between the second annular seal surface and the fourth annular seal surface, and a lid including a closure and a fluted closure mount ring appended to the closure and coupled to the brim to retain the closure in a position closing a mouth opening into a liquid reservoir chamber formed in the cup, the fluted closure mount ring including a first seal ring arranged to engage the radially inwardly facing first annular seal surface to establish a first liquid flow barrier therebetween, a second seal ring arranged to engage the radially inwardly facing second annular seal surface to establish a second liquid flow barrier therebetween, a third seal ring arranged to engage the axially upwardly facing third annular seal surface to establish a third liquid flow barrier therebetween, and a fourth seal ring arranged to engage the radially outwardly facing fourth annular seal surface to establish a fourth liquid flow barrier therebetween, wherein the fluted closure mount ring further includes a lid-removal flange located below the fourth seal ring and arranged to extend downwardly in an inner direction toward the floor of the cup.

* * * * *